US008590337B2

(12) United States Patent
Lafaire

(10) Patent No.: US 8,590,337 B2
(45) Date of Patent: Nov. 26, 2013

(54) CONDENSER ASSEMBLY FOR AN APPLIANCE

(75) Inventor: Juan Antonio Contreras Lafaire, Anderson, SC (US)

(73) Assignee: Eletrolux Home Products, Inc., Charlotte, NC (US)

( * ) Notice: Subject to any disclaimer, the term of this patent is extended or adjusted under 35 U.S.C. 154(b) by 736 days.

(21) Appl. No.: 12/714,082

(22) Filed: Feb. 26, 2010

(65) Prior Publication Data

US 2010/0236762 A1 Sep. 23, 2010

Related U.S. Application Data

(60) Provisional application No. 61/162,495, filed on Mar. 23, 2009, provisional application No. 61/156,145, filed on Feb. 27, 2009.

(51) Int. Cl.

| | |
|---|---|
| ***F25B 39/04*** | (2006.01) |
| ***F25D 17/04*** | (2006.01) |
| ***F25D 19/00*** | (2006.01) |
| ***F28D 1/00*** | (2006.01) |
| ***F28D 1/02*** | (2006.01) |

(52) U.S. Cl.
USPC ..... 62/506; 62/428; 62/454; 62/455; 165/149; 165/150; 165/151; 165/171

(58) Field of Classification Search
USPC ..... 165/149, 150, 151, 171; 62/428, 454, 62/455
See application file for complete search history.

(56) References Cited

U.S. PATENT DOCUMENTS

| | | | | |
|---|---|---|---|---|
| 2,702,459 | A | 2/1955 | Thompson | |
| 2,811,840 | A | 5/1957 | Thompson | |
| 2,797,553 | A * | 7/1957 | Baillif | 62/295 |
| 4,047,393 | A | 9/1977 | Hanson et al. | |
| 4,555,915 | A | 12/1985 | Dasher | |
| 5,502,983 | A * | 4/1996 | Dasher | 62/454 |
| 7,204,097 | B2 | 4/2007 | Sessa et al. | |
| 7,600,388 | B2 | 10/2009 | Vestal | |
| 2004/0000162 | A1 * | 1/2004 | Song | 62/441 |
| 2004/0016255 | A1 * | 1/2004 | Kim et al. | 62/258 |
| 2005/0120738 | A1 * | 6/2005 | Chun et al. | 62/455 |
| 2005/0160760 | A1 * | 7/2005 | Chae et al. | 62/454 |
| 2005/0178139 | A1 * | 8/2005 | Kim | 62/277 |
| 2008/0164016 | A1 * | 7/2008 | Lee et al. | 165/178 |

FOREIGN PATENT DOCUMENTS

| | | |
|---|---|---|
| JP | 04335980 | * 11/1992 |

* cited by examiner

*Primary Examiner* — Frantz Jules
*Assistant Examiner* — Erik Mendoza-Wilkenfel
(74) *Attorney, Agent, or Firm* — Pearne & Gordon LLP

(57) ABSTRACT

A condenser assembly for an appliance is provided. The condenser assembly can include a horizontally extending condenser coil assembly that has a plurality of supporting connectors that are arranged at an angle to the flow direction of cooling air. Cooling air is drawn through the refrigerator and across a length of the condenser coil by an air mover. Additionally, a baffle works in conjunction with the air mover to direct cooling air through the condenser coil and connectors.

17 Claims, 7 Drawing Sheets

CONDENSER ASSEMBLY FOR AN APPLIANCE

CROSS-REFERENCE TO RELATED APPLICATIONS

This application claims the benefit of U.S. Provisional Application No. 61/162,495, filed Mar. 23, 2009, and U.S. Provisional Application No. 61/156,145, filed Feb. 27, 2009, the entire disclosures of which are hereby incorporated herein by reference.

FIELD OF THE INVENTION

The present invention relates generally to a refrigeration cycle apparatus of an appliance, and more particularly, to a condenser assembly of the refrigeration cycle apparatus.

BACKGROUND OF THE INVENTION

Many appliances include a refrigeration cycle apparatus. For example, a refrigerator is an electrical appliance in which a refrigeration cycle uses a refrigerant to store food and beverages at a low temperature. Traditionally, the refrigeration cycle apparatus of a refrigerator utilizes a compressor, a condenser, an expansion valve and an evaporator connected to an insulated container. The compressor compresses a vaporized refrigerant, which also increases the temperature of the refrigerant. A condenser transfers thermal energy away from the refrigerant and into the ambient environment outside the refrigerator.

In conventional refrigerators, the metal coils of the evaporator or condenser may contain fins to increase the surface area for heat transfer. However, these fins can restrict the cooling airflow and limit the amount of cooling air that can pass through the coils. In addition, poor cooling airflow through the condenser can result in a less than efficient appliance. For example, the cooling air may only partially penetrate the entire length of the condenser coil, thus lowering the heat-transfer efficiency. Also, the rate of heat transfer may be less efficient since the surface area of the condenser coils is limited.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In one aspect, an appliance is provided, comprising a machine room defined by a bottom portion, a top portion, and a plurality of side wall. An air intake is in fluid communication with the machine room, and an air mover provides cooling air to the machine room via the air intake. A condenser assembly is in the machine room in fluid communication with the air mover and air intake. The condenser assembly comprises a horizontally extending condenser coil comprising an array of tubing layers forming a plurality of vertically arranged rows, and a plurality of connectors vertically attached to at least two of the vertically arranged rows, in thermal communication with the condenser coil, and oriented at an angle with respect to said at least two rows.

In another aspect, an appliance is provided, comprising a machine room defined by a bottom portion, a top portion, and a plurality of side walls. An air intake is in fluid communication with the machine room, and an air mover provides cooling air to the machine room via the air intake. A condenser assembly with a horizontally extending condenser coil is disposed in the machine room in fluid communication with the air mover and air intake, and at least one baffle extends along at least a portion of the condenser coil to define a fluid path extending from the air intake, to a first end of the condenser assembly, and then to a second end of the condenser assembly.

In another aspect, an appliance is provided, comprising a machine room defined by a bottom portion, a top portion, and a plurality of side walls. An air intake is in fluid communication with the machine room, and an air mover provides cooling air to the machine room via the air intake. A condenser assembly is in the machine room in fluid communication with the air mover and air intake, comprising a horizontally extending condenser coil defining an array of tubing layers and a plurality of connectors vertically attached to at least two of the array of tubing layers and in thermal communication with the condenser coil. At least one baffle extends along at least a portion of the condenser coil to define a fluid path extending from the air intake, to a first end of the condenser assembly, and then to a second end of the condenser assembly.

BRIEF DESCRIPTION OF THE DRAWINGS

The foregoing and other aspects of the present invention will become apparent to those skilled in the art to which the present invention relates upon reading the following description with reference to the accompanying drawings, in which.

Wherever the same component appears in more than one figure of the drawings, it is identified in all the figures in which it appears by the same reference numeral.

DETAILED DESCRIPTION OF THE INVENTION

Figure 1:
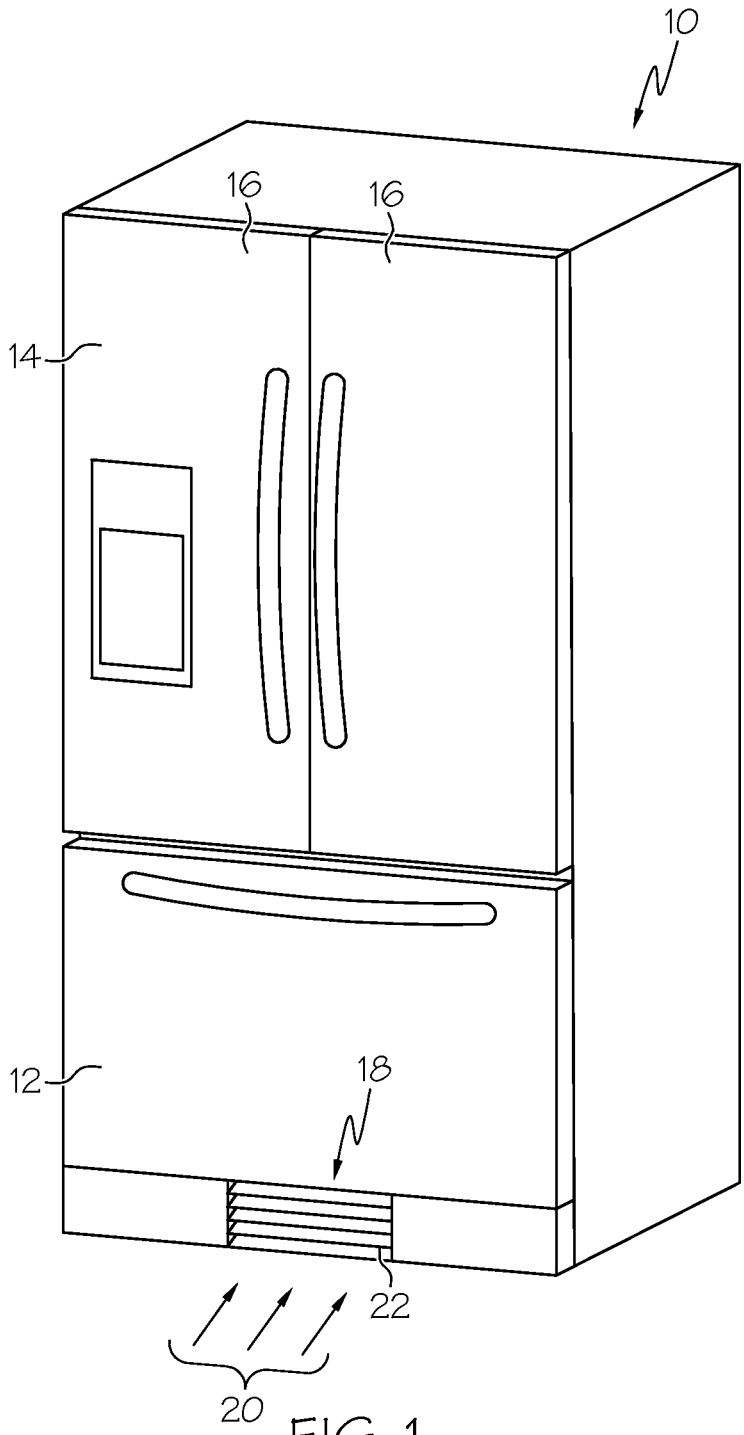
FIG. 1 illustrates a perspective view of an example appliance.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Turning to FIG. 1, an example appliance is illustrated. For example, the appliance can be a refrigerator 10. While the following application will be discussed with reference to a refrigerator 10, it is to be understood that various other appliances that include a refrigeration cycle apparatus can also be used, such as freezers, air conditioning units, other cooling units, heating units, etc. The shown example refrigerator 10 includes a freezer compartment 12 and a fresh food compartment 14 with double doors 16, though various other refrigerator configurations can also be used. The freezer compartment 12 is used to freeze and/or maintain food articles in a frozen condition, generally below zero degrees Centigrade. The fresh food compartment 14 is used to keep food articles fresh and maintain them at a cool temperature generally above zero degrees Centigrade.

The refrigerator 10 includes at least one air intake 18. The air intake can be located in any suitable location and have various configurations. For example, the air intake 18 may be located towards the bottom, front side of the refrigerator 10, and may extend partially or completely therealong. The air intake 18 allows cooling air 20 from the external environment to enter into the refrigerator 10. The air intake may include a cover 22, such as a grille or the like, that may include a series of openings to allow cooling air 20 to pass through the air intake 18. In one example, the air intake 18 may be a recess or series of openings in the front or rear of the refrigerator 10 that may allow flowing communication with a machine room 24. The air intake 18 can further include a removable or non-removable air filter (not shown), air damper (not shown), or the like.

Figure 2:
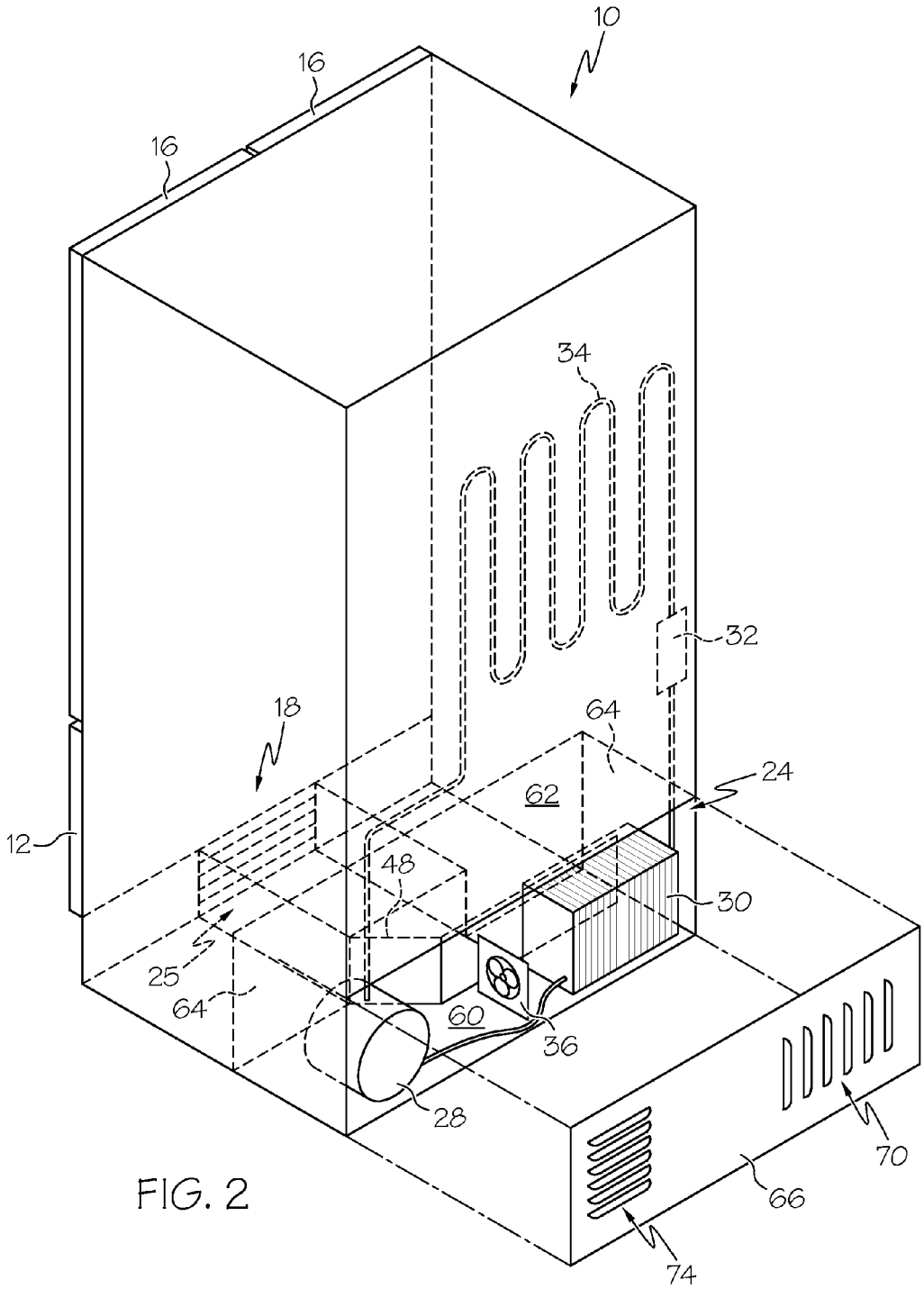
FIG. 2 illustrates a perspective view of the rear of the appliance of FIG. 1.

Turning to the example of FIG. 2, there is shown a machine room 24 arranged towards the bottom rear of the refrigerator 10. The machine room 24 provides a space for the refrigeration cycle apparatus, as well as other structure of the refrigerator 10. The machine room 24 can be defined variously by various surfaces, such as by various removable or non-removable walls, and can have various configurations. In one example, the machine room 24 can be defined by a bottom portion 60, a top portion 62 and a plurality of side walls 64, as will be discussed herein. The machine room 24 may also include a back wall 66 to enclose the refrigeration cycle apparatus. The back wall 66 can be removable, and/or can be made of a lightweight material such as cardboard or other generally rigid material. Any of the walls of the machine room 24, such as the back wall 66, can include various air openings for intake and/or exhaust of cooling air.

The example refrigeration cycle apparatus can includes compressor 28, a condenser assembly 30, an expansion valve 32, and at least one evaporator 34, though can also include more or less elements as desired. The refrigeration cycle apparatus works in a way that is known in the art. In one example, a chemical, such as R-134a or the like, may be used as refrigerant for the refrigeration cycle.

The refrigerant vapor enters the compressor 28 from a suction pipe at the low-pressure side, is compressed to a high pressure and is then distributed to a pressure pipe by the compressor 28. The refrigerant gas enters into the condenser assembly 30 from an inlet side 31 and is cooled such that it gradually condenses to a warm condensate. The warm condensate flows from an outlet side 33 of the condenser towards at least one evaporator 34 via the expansion valve 32 under a considerably lower pressure. The low pressure condensate now takes up heat from the cooling space (e.g., freezer compartment 12 and/or fresh food compartment 14 and/or an ice-maker (not shown)) in which the evaporator 34 is in thermal communication. Simultaneously, the refrigerant boils and the vapor that is created has a low pressure and flows back towards the suction pipe of the compressor 28 where the cycle repeats. The cooling air 20 provided by the air intake 18 cools the refrigerant, via the condenser assembly 30, as the cooling air 20 flows across the condenser assembly 30 so that thermal energy of the refrigerant is transferred into the ambient environment. It is to be understood that various other elements and/or processes can also be included as desired.

Figure 3:
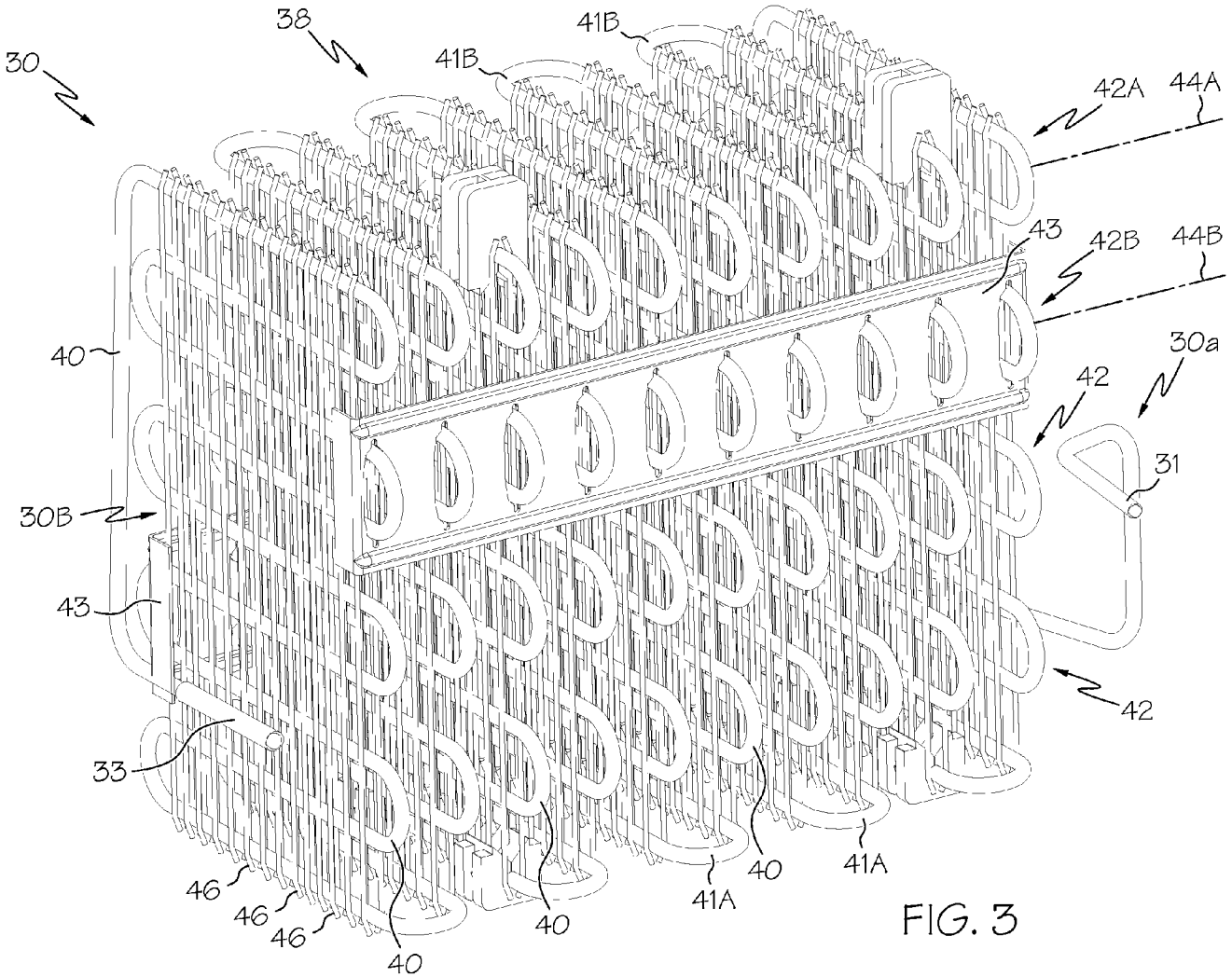
FIG. 3 illustrates a perspective view of an example condenser assembly.
Figure 4:
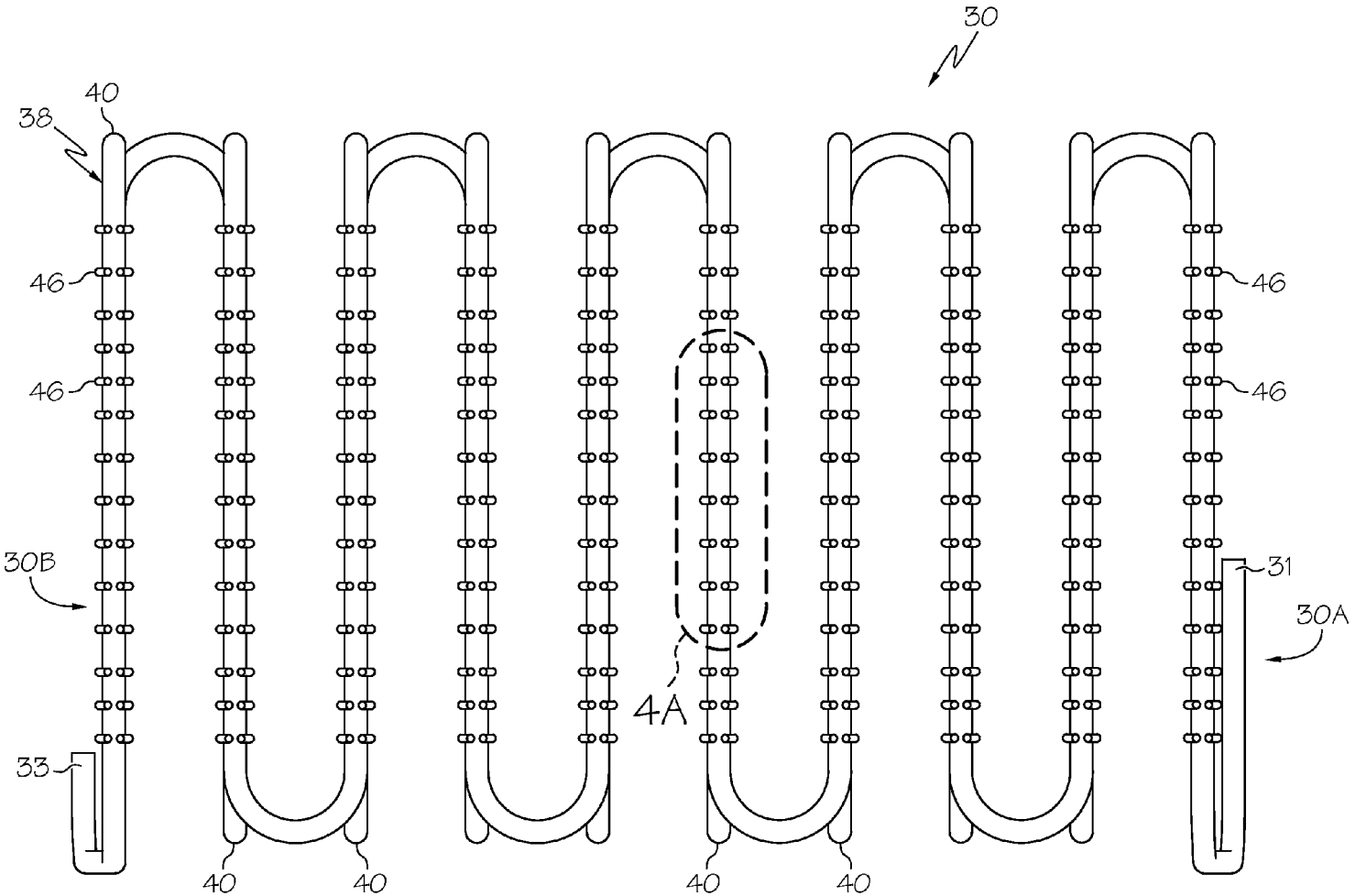
FIG. 4 illustrates a top view of the condenser assembly of FIG. 3.

Turning to the examples of FIGS. 3-4, there is shown one example condenser assembly 30. The condenser assembly 30 is located in the machine room 24, and is in flowing communication with cooling airflow 20 provided by at least one air mover 36, such as an electric fan, that is located variously. For example, the source of the cooling airflow 20 can be provided from the air intake 18. In another example, the air mover 36 can be located towards an end of the condenser assembly 30.

The condenser assembly 30 can include at least one condenser coil 40 that is arranged as a horizontally extending array of tubing layers 38. Each of the tubing layers 38 can include at least one serpentine repetition that forms a plurality of vertically arranged, such as stacked, rows 42. The serpentine repetitions can be made from bending the metal tubing (e.g., the at least one condenser coil 40) that forms the tubing layers 38, or by adding a tubing coupler, etc. Thus, the condenser coil 40 can be a unitary tube, or a plurality of tubes coupled together, to form the desired horizontally extending array of tubing layers 38. For example, as shown, the tubing layers 38 can be connected by a bottom coil 41A and/or a top coil 41B to form the array that extends horizontally across a portion of the machine room 24 (see FIG. 5). Each tubing layer 38 of the horizontally extending array is in fluid communication with every other tubing layer 38 such that a flow of refrigerant through the condenser assembly 30 is substantially continuous from the inlet side 31 to the outlet side 33. In addition or alternatively, one or more support members 43 can be provided along a portion of either a horizontal or vertical extent of the condenser assembly 30 to maintain a desired spacing and/or structural support of the condenser coil(s) 40.

The plurality of vertically stacked rows 42 can be arranged such that each tubing layer 38 of the condenser assembly 30 resides on one of a plurality of horizontal planes. For example, a first row 42A can be oriented on a first horizontal plane 44A, and a second row 42B can be oriented on a second horizontal plane 44B. As shown, the first row 42A of the first horizontal plane 44A can be arranged adjacent to the second row 42B of the second horizontal plane 44B. In one example, the horizontal planes can be substantially parallel to each other. For example, the first horizontal plane 44A can be substantially parallel to the second horizontal plane 44B. Some or all of the horizontal planes can be arranged generally straight, or can even be angled. As can be appreciated from the examples of FIGS. 3-4, the arrangement of the condenser coil(s) 40 can arrange the tubing layers 38 in an array of column(s) and row(s). It is to be understood that the arrangement of the tubing layers 38 can be generally equal throughout, or can have various portions arranged closer or farther apart to provide a desired thermal energy transfer scheme.

The condenser assembly 30 can further include a plurality of connectors 46. The plurality of connectors 46 can provide support to the at least one serpentine repetitions of the condenser assembly 30. In one example, the plurality of connectors 46 can be attached to at least two of the vertically stacked rows 42 in a removable or non-removable manner, such as via welding, fasteners (e.g., bolts, screws, clips, magnets, hooks, etc.), adhesives, etc. In one example, the plurality of connectors 46 can be coupled to each row 42, though in other examples the connectors 46 may only be coupled to a select portions of the condenser coil(s) 40. The plurality of connectors 46 can interconnect some or all of the plurality of vertically stacked rows 42. The connectors 46 can be made of metal or other material with a relatively high heat transfer rate, and are in thermal communication with the condenser coil(s) 40. Thus, thermal energy can be transferred, via conduction, from the condenser coil(s) 40 of the condenser assembly 30 to the connectors 46, and thereafter to the cooling airflow 20 via convection.

Thus, the heat-transfer surface of the condenser assembly 30 is increased to provide for a relatively greater rate of thermal transfer from the condenser assembly 30. For example, this can allow relatively more of the cooling air 20 to come into contact with the condenser assembly 30. If the condenser assembly 30 contacts more of the cooling air 20, then relatively more thermal energy absorbed by the refrigerant from the freezer and/or fresh food compartment(s) 12, 14 can be transferred into the ambient environment.

The connectors 46 can be arranged variously relative to the plurality of vertically stacked rows 42. In one example, the connectors 46 can be arranged at an angle with respect to the plurality of rows 42. For example, some or all of the connectors 46 can be arranged transverse to the rows 42 and/or some or all of the connectors 46 can be arranged perpendicular to the rows 42. The connectors 46 can extend across a plurality of the horizontal planes 44A, 44B.

Figure 4A:
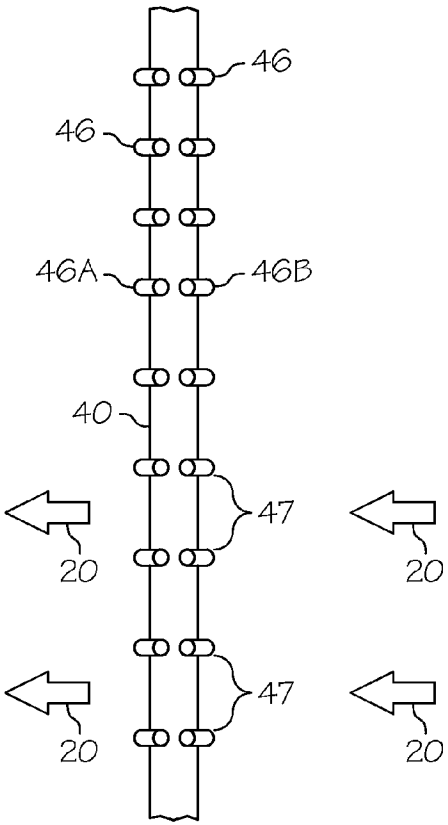
FIG. 4A illustrates a detail view of the condenser assembly of FIG. 4.

Turning to FIG. 4A, a detail view is shown. In one example, the plurality of connectors 46 can include a first connector 46A and a second connector 46B. The first and second connectors 46A, 46B can be attached as pairs on opposing sides of the metal tubing of each tubing layer 38. Adjacent connectors 46 can form airflow channels 47 therebetween to permit the cooling airflow 20 through the condenser assembly 30. In addition or alternatively, the pairs of connectors 46 can be arranged substantially parallel to each other. As shown, the pairs of connectors 46 can be generally evenly spaced, though portion of the connectors 46 can have various relative spacing. For example, some adjacent connectors 46 can be positioned closer together or farther apart to control airflow, such as to create high or low velocity and/or pressure zones. In another example, the pairs of connectors 46 are arranged to be diametrically opposed to each other. In yet other embodiments, the connector 46 or a plurality of connectors 46 may form various arrangements, such as a matrix in the form of a grid, a sunburst, "X" shapes, diagonal patterns, random, or any other arrangements that provide desired surface area. Preferably, the arrangement does not significantly decrease the potential flow of cooling air 20 through the condenser coil(s) 40. In addition or alternatively, the connectors 46 may be connected to one tubing layer 38, or they may be connected to multiple tubing layers 38. In addition or alternatively, the connectors 46 may at least partially wrap themselves around portions of the condenser coil(s) 40, such as at the top or bottom.

The condenser coil(s) 40 and the connectors 46 can be arranged variously to increase the surface area of the condenser assembly 30. In one example, the condenser coil(s) 40 and the plurality of connectors 46 can be arranged substantially transverse to a flow direction of the cooling air 20. In another example, the condenser coil(s) 40 and the connectors 46 can be arranged perpendicular to the flow direction of the cooling air 20. In further examples, the condenser coil(s) 40 and the plurality of connectors 46 can be arranged substantially transverse or perpendicular to a direction of one or more tubing layer 38. Since the connectors 46 are in thermal communication with the condenser assembly 30 and are arranged to increase the surface area of the condenser coil(s) 40 relative to the cooling airflow 20, the efficiency of transferring thermal energy is increased. This can result in a relatively lower refrigerant temperature exiting the condenser assembly 30, which ultimately can cool the refrigerator 10 more efficiently.

Figure 5:
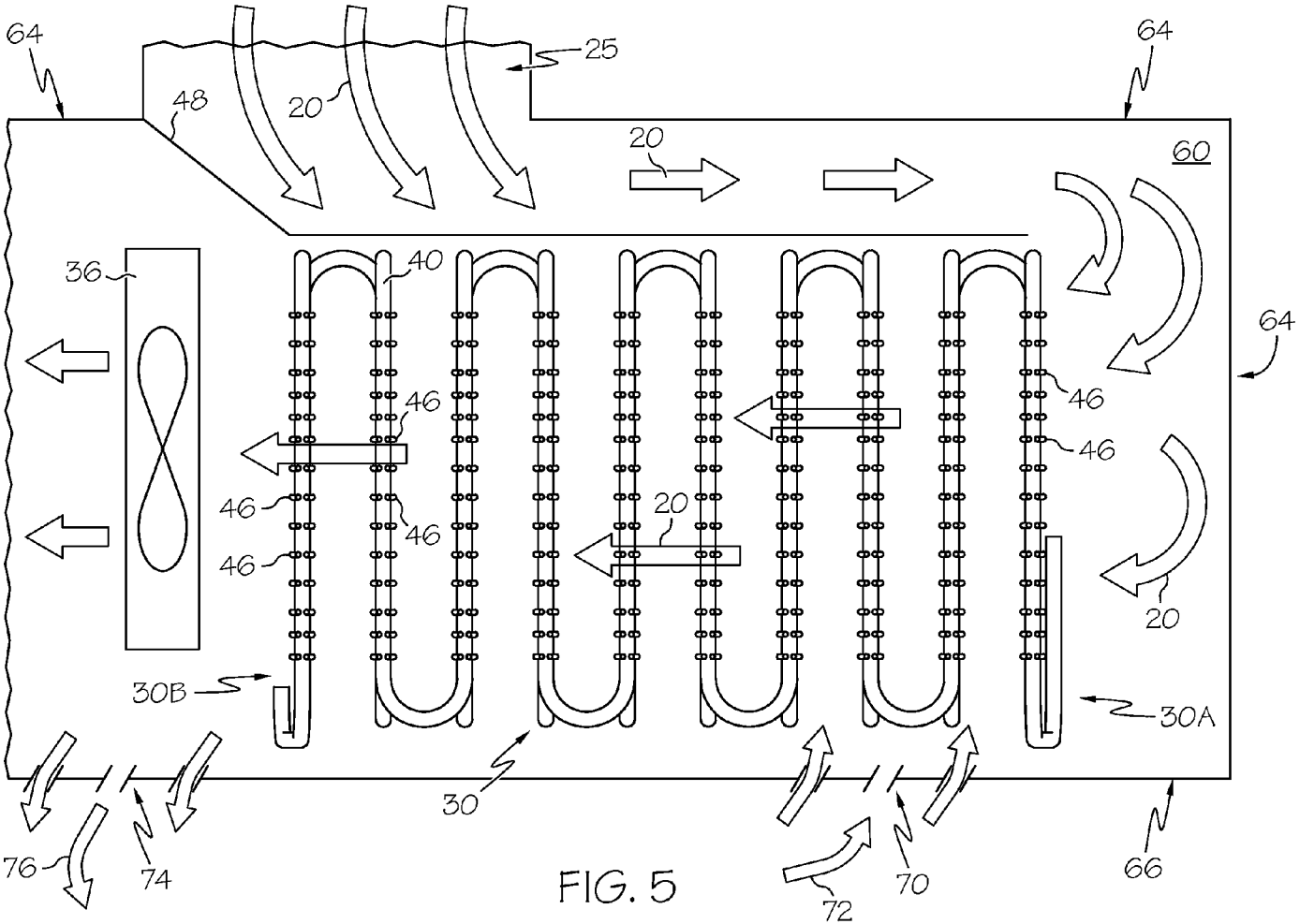
FIG. 5 illustrates a top view of the condenser assembly of FIG. 3 with an example air flow.

Turning to the example of FIG. 5, which is a top view, there is shown a condenser assembly 30 in the example machine room 24. Conventionally, cooling air 20 can navigate around and/or bypass a portion, such as an end, of the condenser assembly 30 instead of flowing across a greater length of the condenser assembly 30, which reduces heat-transfer efficiency. To counteract this, at least one baffle 48 can be positioned to extend along at least a portion of the condenser assembly 30. The at least one baffle 48 can be positioned so that the cooling air 20 entering the machine room 24 from the air intake 18 flows across a major portion, such as substantially the entire length, of the condenser assembly 30. In one example, the at least one baffle 48 is disposed between the air intake 18 and the condenser assembly 30. In another example, the at least one baffle 48 deflects incoming cooling air 20 towards the first end 30A of the condenser assembly 30 and to flow therethrough. Thus, the baffle 48 can inhibit the flow of cooling air 20 from bypassing portion(s) of the condenser assembly 30.

The positioning of the at least one baffle 48 can define a fluid path extending from the air intake 18 to the first end 30A of the condenser assembly 30, and then to a second end 30B of the condenser assembly 30 (see FIG. 5). In one example, the fluid path extends across a substantial portion, such as all, of the length of the horizontally extending condenser coil(s) 40 from the first end 30A to the second end 30B. The fluid path can also be defined by other structure, such as the various portions 60, 62, 64, 66 of the machine room 24, and/or the air intake 18 and/or air channel 25. In one example, the air mover 36 can be positioned adjacent to the second end 30B of the condenser assembly 30 to draw in cooling air 20 through the air intake 18 via the air channel 25, and the at least one baffle 48 then directs the cooling air across the length of the condenser assembly 30 such that the cooling air 20 flows through a majority, such as all, of the tubing layers 38 and connectors 46. Thus, the air mover 36 can draw the cooling air 20 along the fluid path. In another example, the air mover 36 can be positioned adjacent to the first end 30A of the condenser assembly 30, or even behind the baffle 48 or in the air channel 25, to provide the cooling air 20 along the fluid path and through the condenser assembly 30. It is to be understood that a plurality of air movers 36 can be provided to direct the cooling airflow 20 as desired.

The baffle 48 can be formed of various materials and have various configurations to direct the cooling airflow 20 as desired. In one example, the baffle 48 can be formed of a generally rigid material, and/or can be angled or otherwise oriented to deflect the cooling air 20 initially towards the first end 30A of the condenser assembly 30. The baffle 48 can be formed of a single element, or can be a plurality of elements coupled together. In addition or alternatively, the baffle 48 can be adjustable, such as telescoping, bendable, etc., and/or can even include additional airflow modifiers, such as inlet/outlet holes, air deflectors, velocity or pressure modifiers, etc. It is further to be understood that the baffle 48 can be a separate element, or can even cooperate together with the various portions 60, 62, 64, 66 of the machine room 24. In yet another embodiment, the at least one baffle 48 may have diffusers (not shown) on at least one surface in order to further direct cooling air 20 to and/or through the condenser assembly 30. Additionally, at least one baffle 48 may be located on one side of the condenser assembly 30 in order to direct the cooling air 20. In other embodiments, the at least one baffle 48 may be located on a plurality of sides of the condenser assembly 30.

Figure 5A:
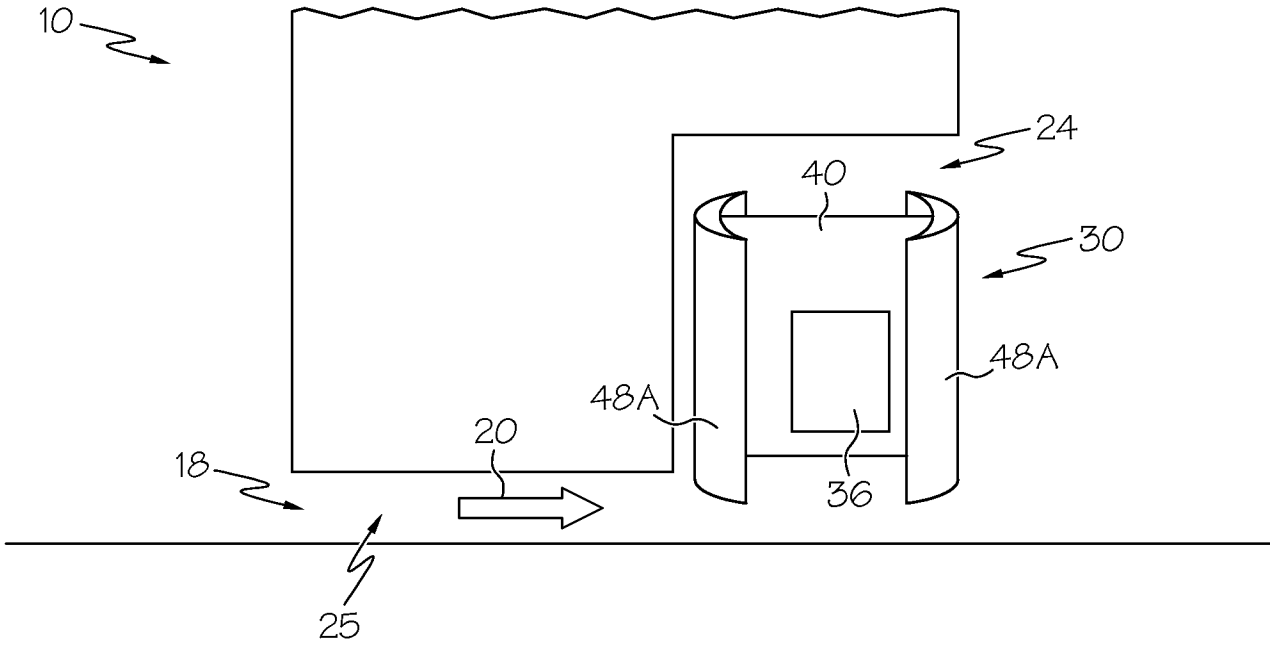
FIG. 5A illustrates a partial view of another example condenser assembly with another example airflow.

In another embodiment, one end of the at least one baffle 48 may be adjacent to the air intake 18 and the opposing end of the at least one baffle 48 may terminate close to the air mover 36 so as to guide cooling air 20 into the condenser assembly 30 and inhibit, such as prevent, any cooling air 20 from going around the condenser assembly 30. For example, as shown schematically in FIG. 5A, the baffle 48A can be disposed at least partially along the length of the condenser assembly 30 so as to at least partially surround it. In addition or alternatively, the baffle 48 can be coupled to the condenser assembly 30 so as to provide a single, drop-in element. In yet other embodiments, one end of the at least one baffle 48 may be located near the air intake 18 and the opposing end of the at least one baffle 48 may terminate about a specific portion of the condenser assembly 30.

The at least one baffle 48 may take the form of various air guides. The at least one baffle 48 may have straight sides, or have a cross section geometry that resembles airfoils, turbine blades, and/or may also be scoop shaped, etc. The at least one baffle 48 may also be a shaped to inhibit, such as prevents, cooling air 20 from flowing outside the boundaries of the condenser assembly 30. As an example, the at least one baffle 48 may cooperate together with some of the interior walls of the machine room 24, where those interior walls may be shaped or contoured to efficiently direct the cooling air 20. In addition or alternatively, some of the interior walls of the machine room 24 can include other air-guide structure, etc. The at least one baffle 48 may behave as an air nozzle, concentrating the cooling air 20 in a smaller volume of space, causing an increase in air pressure, or conversely into a larger volume of space, causing a decrease in air pressure. Additionally, the velocity of the cooling air 20 could also increase or decrease, which can also help in transferring thermal energy away from the condenser assembly 30.

In addition or alternatively, as shown in FIGS. 2 and 5, the back wall 66 of the machine room 24 can include at least one conduit, such as an inlet and/or an outlet, for additional air flow. The back wall 66 can include one or more openings extending therethrough for defining the inlet and/or outlet. For example, an auxiliary inlet 70 can be provided through the back wall 66 for permitting additional cooling air 72 to enter the machine room 24. In one example, the auxiliary inlet 70 can be located generally towards the first end 30A of the condenser assembly 30 such that the additional cooling air 72 can add to the main cooling airflow 20 that is flowing through the condenser assembly 30. Similarly, an auxiliary outlet 74 can be provided through the back wall 66 for permitting used cooling air 76 to exit the machine room 24. In one example, the auxiliary outlet 74 can be located generally towards the second end 30B of the condenser assembly 30, and possibly downstream of the air mover 36, such that some or all of the used cooling air 76 (e.g., cooling airflow 20 that has passed at least partially through the condenser assembly 30) to exit the machine room 24. Still, the auxiliary input 72 and/or outlet 74 can be disposed variously and can have various geometries, airflow modification features, etc. In addition or alternatively, an auxiliary air mover (not shown) can also be provided about either or both of the inlet and outlet 70, 74 to enhance airflow.

During one example operation, the refrigerator 10 powers the air mover 36. A flow of cooling air 20 is pulled from the ambient environment through the air intake 18, through the air channel 25, and into the machine room 24. Once inside the machine room 24, the cooling air 20 is directed via the baffle 48 towards one end (e.g., 30A) of the condenser assembly 30. The cooling air 20 then flows through the condenser coil(s) 40, and plurality of connectors 46, which draws thermal energy away from the tubing layers 38 and the refrigerant flowing therein. Once the cooling air 20 travels through the condenser assembly 30, it then may flow through the air mover 36 and back into the ambient environment. This process is repeated during operation of the cooling apparatus.

The present application can provide various beneficial aspects. For example, it can provide a refrigerator with an increase in cooling efficiency over conventional refrigerators. It is another beneficial aspect to provide a refrigerator that consumes relatively little energy during normal operation. For example, improving overall thermal energy transfer efficiency reduces the time required to cool the refrigerator, thus generally consuming less energy. It is yet another beneficial aspect to provide a condenser coil that has connectors that are arranged at an angle, such as substantially transverse or perpendicular, to incoming cooling air.

It is yet another beneficial aspect to increase the heat-transfer surface of the condenser coil by using a plurality of connectors. It is yet another beneficial aspect to provide connectors that are suited to transferring thermal energy. It is yet another beneficial aspect to provide an increased amount of cooling air to the connectors through the use of an air diffuser or baffle. It is yet another beneficial aspect to provide an efficient location of the cooling air intake so that an increased amount of cooling air can be directed through the condenser coil.

It is to be understood that the names given to specific stages or elements, and/or order of operation identifiers (i.e., "first," "second"), and/or orientation (i.e., "horizontal," "vertical") are intended merely for convenience and ease of reference for the reader, so he/she can more easily follow the present description and the associate drawings. It is in no way intended that each of the described elements must be a single, discreet or unitary machine or device, or that specific elements need to be provided together or in close association with the other elements described herein with respect to a particular stage, or that particular operations must occur in a particular order or using a particular machine. It is contemplated that various elements of the disclosed apparatus can be rearranged, or located in association with the same or different elements as herein described.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. An appliance comprising:

a machine room located at a rear lower side of the appliance and defined by a bottom portion, a top portion, a plurality of side walls, and a back wall of the appliance;

an air intake located at a front lower side of the appliance and in fluid communication with the machine room and being separated from the machine room by an enclosed air channel that extends between the air intake and the machine room;

an air mover for providing cooling air to the machine room via the air intake; and a condenser assembly located at a rear lower side of the appliance in the machine room in fluid communication with the air mover, and with the air intake via the air channel, the condenser assembly comprising:

a condenser coil extending horizontally between an opposed pair of the plurality of side walls comprising: an array of tubing layers forming a plurality of vertically arranged rows extending between a bottom portion and a top portion of the machine room; and a plurality of connectors vertically attached to at least two of the vertically arranged rows, in thermal communication with the condenser coil, and oriented at an angle with respect to said at least two rows; and the appliance further comprising:

at least one baffle disposed at an end of the air channel adjacent the machine room and configured to direct the flow of cooling air by extending from the air intake to the machine room, along a first direction between said opposed pair of the plurality of side walls and along at least a major horizontal portion of the condenser coil to thereby define a fluid path extending through a major horizontal portion of the condenser coil, wherein the at least one baffle thereby defines the fluid path as substantially continuously extending from the air intake, through the air channel, in the first direction along the condenser coil but separated from the condenser coil by the at least one baffle, against one sidewall of the machine room to change direction to a second direction, to a first end of the condenser assembly, through substantially the entire length of the condenser coil, and then to a second end of the condenser assembly.

2. The appliance of claim 1, wherein the plurality of connectors vertically interconnect the plurality of rows of the array of tubing layers.

3. The appliance of claim 1, wherein the plurality of connectors increase the surface area of the condenser assembly to provide a relatively greater rate of thermal energy transfer from the condenser assembly.

4. The appliance of claim 1, wherein the plurality of connectors are arranged substantially transverse to a flow direction of the cooling air.

5. The appliance of claim 1, wherein the plurality of connectors are arranged substantially transverse to a direction of a tubing layer.

6. The appliance of claim 1, wherein a pair of substantially parallel connectors are attached on opposing sides of the tubing of each tubing layer.

7. The appliance of claim 1, wherein the at least one baffle extends along substantially the entire length of the horizontally extending condenser coil to define the fluid path as extending in the first direction along substantially the entire length of the condenser coil but separated from the condenser coil by the at least one baffle.

8. An appliance comprising:

a machine room located at a rear lower side of the appliance and defined by a bottom portion, a top portion, a plurality of side walls, and a back wall of the appliance;

an air intake located at a front lower side of the appliance and in fluid communication with the machine room and being separated from the machine room by an enclosed air channel that extends between the air intake and the machine room;

an air mover for providing cooling air to the machine room via the air intake;

a condenser assembly with a horizontally extending condenser coil disposed at a rear lower side of the appliance in the machine room adjacent to said back wall and in fluid communication with the air mover, and with the air intake via the air channel; and at least one baffle disposed at an end of the air channel adjacent the machine room and configured to direct the flow of cooling air by extending from the air intake to the machine room and along substantially the entire length of the horizontally extending condenser coil, the condenser assembly positioned between the at least one baffle and said back wall of the appliance to thereby define a substantially continuous fluid path extending from the air intake, through the air channel, in a first direction along the condenser coil but separated from the condenser coil by the at least one baffle, against one sidewall of the machine room to change direction to a second direction generally opposite the first direction, to a first end of the condenser assembly, through substantially the entire length of the condenser coil, and then to a second end of the condenser assembly such that the fluid path extends across substantially the entire length of the horizontally extending condenser coil from the first end of the condenser assembly to the second end of the condenser assembly, and wherein the air mover is positioned adjacent to the second end of the condenser assembly and draws the cooling air along the fluid path.

9. The appliance of claim 8, where the at least one baffle is disposed between the air intake and the condenser assembly.

10. The appliance of claim 8, wherein the at least one baffle deflects incoming cooling air towards the first end of the condenser assembly and subsequently through the condenser assembly and the air mover.

11. The appliance of claim 8, wherein the condenser assembly includes a plurality of connectors attached to a plurality of vertically arranged rows and in thermal communication with the condenser coil.

12. The appliance of claim 11, wherein at least two of said plurality of connectors are arranged at an angle with respect to said at least two rows.

13. An appliance comprising:

a machine room located at a rear lower side of the appliance and defined by a bottom portion, a top portion, a plurality of side walls, and a back wall of the appliance;

an air intake located at a front lower side of the appliance and in fluid communication with the machine room and being separated from the machine room by an enclosed air channel that extends between the air intake and the machine room;

an air mover for providing cooling air to the machine room via the air intake;

a condenser assembly at a rear lower side of the appliance in the machine room adjacent to said back wall and in fluid communication with the air mover, and with the air intake via the air channel, comprising a condenser coil extending horizontally between an opposed pair of the plurality of side walls and defining an array of tubing layers and a plurality of connectors vertically attached to at least two of the array of tubing layers and in thermal communication with the condenser coil; and at least one baffle disposed at an end of the air channel adjacent the machine room and configured to direct the flow of cooling air by extending from the air intake to the machine room and along at least a major horizontal portion of the condenser coil, the condenser assembly positioned between the at least one baffle and said back wall of the appliance to thereby define a substantially continuous fluid path extending from the air intake, through the air channel, in a first direction along the condenser coil but separated from the condenser coil by the at least one baffle, against one wall of the machine room to change direction to a second direction generally opposite the first direction, to a first end of the condenser assembly, through substantially the entire length of the condenser coil, and then to a second end of the condenser assembly such that the fluid path extends across a major horizontal portion of the horizontally extending condenser coil from the first end of the condenser assembly to the second end of the condenser assembly.

14. The appliance of claim 13, wherein the plurality of connectors increase the surface area of the condenser assembly to provide a relatively greater rate of thermal energy transfer from the condenser assembly.

15. The appliance of claim 13, wherein the air mover is positioned adjacent to the second end of the condenser assembly and draws the cooling air along the fluid path.

16. The appliance of claim 13, wherein the plurality of connectors are arranged substantially transverse to a flow direction of the cooling air.

17. The appliance of claim 13, wherein the back wall comprises at least one conduit for additional air flow.

* * * * *